United States Patent [19]

Foye

[11] 3,957,105

[45] *May 18, 1976

[54] SELF-CENTERING BOTTOM BLOCK ASSEMBLY FOR D.C. CASTING

[75] Inventor: John J. Foye, Livermore, Calif.

[73] Assignee: Kaiser Aluminum & Chemical Corporation, Oakland, Calif.

[ * ] Notice: The portion of the term of this patent subsequent to Nov. 12, 1991, has been disclaimed.

[22] Filed: Aug. 22, 1974

[21] Appl. No.: 499,729

Related U.S. Application Data

[63] Continuation-in-part of Ser. No. 262,509, June 14, 1972, Pat. No. 3,847,206.

[52] U.S. Cl. ..... 164/274; 164/82

[51] Int. Cl.[2] ..... B22D 11/08

[58] Field of Search ..... 164/274; 198/278, 282; 29/464, 466; 317/101 DH

[56] References Cited

UNITED STATES PATENTS 3,382,476 5/1968 Novet ..... 317/101 DH X 3,847,206 11/1974 Foye ..... 164/274

*Primary Examiner*—R. Spencer Annear

*Attorney, Agent, or Firm*—Paul E. Calrow; Edward J. Lynch

[57] ABSTRACT

This invention relates to an improved self-centering bottom block assembly for D.C. casting. The assembly comprises a bottom block which is slidably mounted on a supporting surface and which is provided with at least two guide extensions. Positioned below the D.C. mold are at least two recessed guide surfaces, the lower portion of which converges in the direction of the discharge end of the mold. The horizontal and rotational movement of the bottom block is restricted so as to ensure the insertion of the guide extensions into the recess defined by the guide surfaces and thereby guide the bottom block into the mold bore without contacting the mold body.

8 Claims, 11 Drawing Figures

SELF-CENTERING BOTTOM BLOCK ASSEMBLY FOR D.C. CASTING

RELATED APPLICATION

This application is a continuaton-in-part of application Ser. No. 262,509 filed June 14, 1972, now U.S. Pat. No. 3,847,206.

BACKGROUND OF THE INVENTION

This invention relates to a bottom block assembly for use in the vertical direct chill (D.C.) casting of metal particularly light metals, such as aluminum.

In the D.C. casting of metals, molten metal is poured into an open-ended tubular mold and begins to solidfy into an ingot. Water is sprayed onto the outside surfaces of the ingot as it emerges from the mold to further cool the ingot and to assist in solidifying the molten metal above the solidified portion of the ingot. At the start of the casting operations, a bottom block or starter block is inserted into the mold bore to seal the discharge end of the tubular mold and to initiate the solidification of the molten metal to form the ingot. Once solidification of the ingot begins, the ingot is urged out of the mold by lowering the bottom block into a pit situated below the casting apparatus. The bottom block may be lowered by hydraulic or other suitable means. In the past, there has been a continual problem with alignment of the bottom block to avoid scuffing, gouging, or other damage to the mold when the bottom block is inserted or withdrawn from the mold.

In a conventional casting station, a plurality of molds (e.g., up to 20 or more) are generally supported on a casting table which can be moved out of position to remove the cast ingots from the pit. A plurality of bottom blocks are rigidly supported on a vertically movable support table. When the support table is raised to insert the bottom blocks into the molds, the operators normally watch for mold movement to determine misalignment of the molds and bottom blocks. Due to the large number of molds at most casting stations, it is impractical for the operators to check each mold to determine if the bottom block is properly aligned. If mold movement is noticed, the raising of the bottom blocks is stopped and the operator, usually by force, repositions the mold. If the mold position cannot be easily adjusted, then the mold would be loosened from the casting table, aligned with the bottom block and refastened to the casting table. In the case of a water-jacketed mold, alignment of the mold and bottom block is more complicated because the coolant and lubricant lines are attached to the mold, and, frequently, these lines would have to be disconnected to position the mold.

Misalignment of the bottom block assembly with respect to the mold can be caused by many various factors. One of the most prevalent is the removal of the ingot from the bottom block assembly after casting. Usually, the bottom block is provided with projections, such as wires, bolt heads and the like, around which metal can solidify so that the bottom block can urge the solidifying ingot out of the mold during the initial period of casting. Shortly after the casting begins, the solidified portion of the ingot is sufficiently heavy to urge the ingot out of the mold and at this point, the bottom block functions to support and control the speed of the ingot withdrawal. When the casting is completed, a lifting device is usually employed to wrench the ingot away from the bottom block. When the ingot is wrenched away from the bottom block, frequently, the bottom would become displaced causing the subsequent misalignment of the bottom block assembly with respect to the mold bore.

In co-pending application Ser. No. 262,509, an improved bottom block design is described and claimed wherein the bottom block is slidably mounted on a support member and is provided with guide members which are adapted to ride guide surfaces positioned below the mold and thereby guide the bottom block into the mold bore. This bottom block assembly was a substantial improvement over conventional bottom block assemblies, but difficulty was experienced in preventing the rotation of the bottom block about the axis of the shaft to which the bottom block support member was affixed. Moreover, when changing over from casting round billets to square or rectangular billets, the mold assembly, bottom block assembly and the guide surfaces had to be changed due to the necessity of the guide surfaces to be uniquely designed for the particular bottom block shape involved.

Against this background, the present invention was developed.

DESCRIPTION OF THE INVENTION

Figure 1:
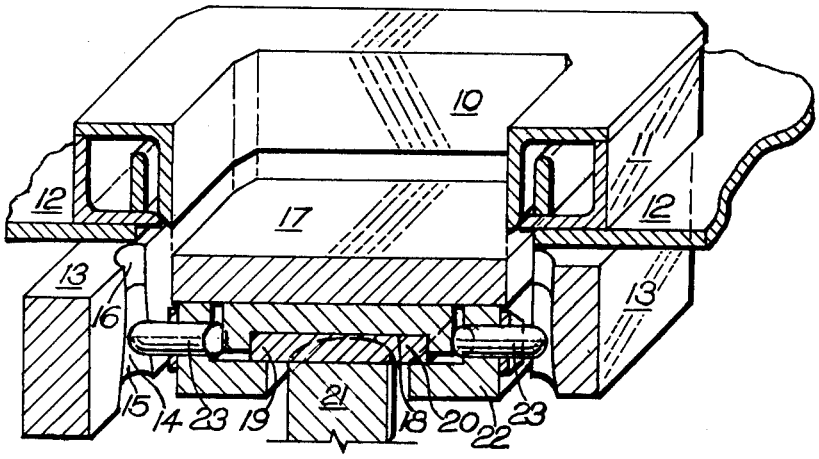
FIG. 1 is a perspective view in section of one embodiment of the invention directed to generally square or rectangularly shaped bottom blocks.
Figure 2:
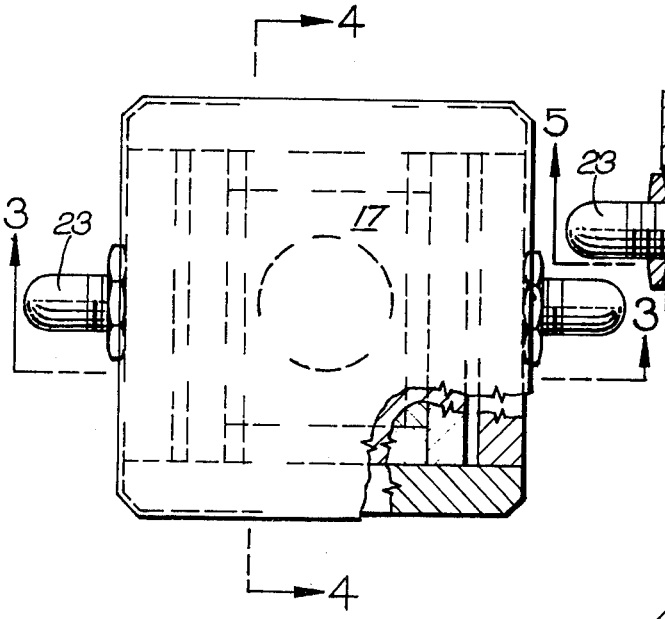
FIGS. 2–5 are various views mostly in section of the embodiment shown in FIG. 1.
Figure 3:
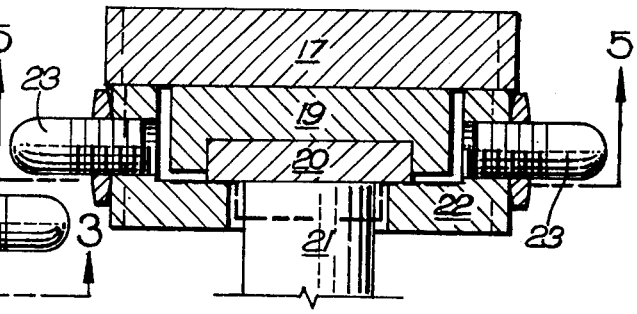
Figure 4:
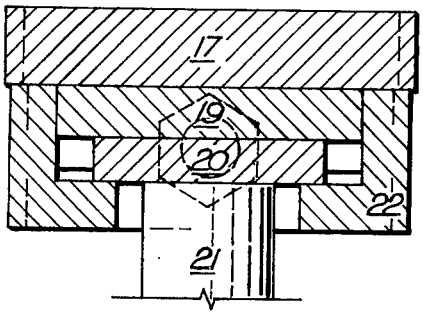

This invention is directed to a self-centering bottom block assembly having improved self-centering characteristics and further being adaptable to various bottom block sizes and shapes.

In accordance with the invention, the assembly comprises a horizontally slidable bottom block mounted on a smaller support member and fixed on the sides of the bottom block are at least two guide extensions. Below the mold body are at least two recessed guide surfaces each of which converge in part toward the discharge end of the mold. Horizontal bottom block movement and bottom block rotation are restricted so as to ensure that, as the bottom block is raised into position, the guide extensions on the bottom block will enter the lower converging section of the recessed guide surfaces and thereby guide the bottom block into the mold bore without contacting the mold body. Preferably, the guide surfaces are supported from a member other than the mold or water jacket to allow for changing of the mold or water jacket without disengagement of the guide surfaces.

Reference is made to FIGS. 1–4 which are various views of one embodiment of the invention directed to a generally square-shaped bottom block and mold. In this embodiment, the mold body 10 and water jacket 11 are mounted on the upper surfaces of mold support plate 12. Depending from and affixed to plate 12 are two members 13 which are provided with recessed guide surfaces 14. Preferably, the guide surfaces 14 comprise two sections, a lower section 15 which converges toward the discharge end of mold 10 and an upper section 16 which generally has the same cross section as the upper end of the converging section 15. The rectangularly shaped bottom block 17 is slidably mounted on support member 18 which comprises a first rectangular member 19 disposed adjacent the underside of bottom block 17 and a second rectangular member 20 which is affixed to shaft 21 and which interfits into the rectangularly shaped recess or trackway provided in the underside of rectangular member 19. Generally, L-shaped member 22 depends from the undersurface of bottom block 17 and thereby loosely locks bottom block 17 to the support member 18 but nonetheless allows for slidable horizontal movement of the bottom block on member 18. At least two guide extensions 23 are provided on the outer surfaces of L-shaped member 22. If desired, a bearing member (not shown) can be disposed between the bottom block 17 and the support member 18. Screw and other type connectors are not shown in the drawing for purposes of clarity.

The rectangular support member 19 interfits into the channel-shaped cavity or trackway defined by the bottom block 17 and L-shaped members 22. One horizontal dimension of member 19 is considerably less than the corresponding dimension of the channel-shaped cavity or trackway so as to restrict member 19 to rectilinear movement in the trackway. A similar channel-shaped cavity or trackway is provided in the lower surface of member 19 into which is seated support member 20. One horizontal dimension of member 20 is considerably less than the corresponding dimension of the channel-shaped cavity in member 19 to allow for rectilinear movement of member 19 with respect to member 20 but which is perpendicular to the relative rectilinear movement between member 19 and bottom block 17. Member 20, which is suitably affixed to shaft 21, does not move in a horizontal plane. Thus, the bottom block can move in two directions which are perpendicular to one another. This movement is shown more clearly in FIGS 2–5. The dimensions of the various members are readily chosen to provide the horizontal movement desired and usually such that equal lateral movement is allowed in both directions. However, the movement is sufficiently restricted to ensure that the guide extensions 23 enter the recess defined by the converging surfaces 15 as the bottom block is raised into position.

In operation, as the bottom block assembly is raised, guide extensions 23 enter the recessed cavities 14 in members 13 and, if the bottom block is out of alignment with the mold bore, at least one of the extensions 23 engages the lower guide surfaces 15, thereby aligning the bottom block 17 with respect to the mold bore. The upper recessed portion 16 allows for accurate insertion of the bottom block 17 into the mold bore.

Figure 5:
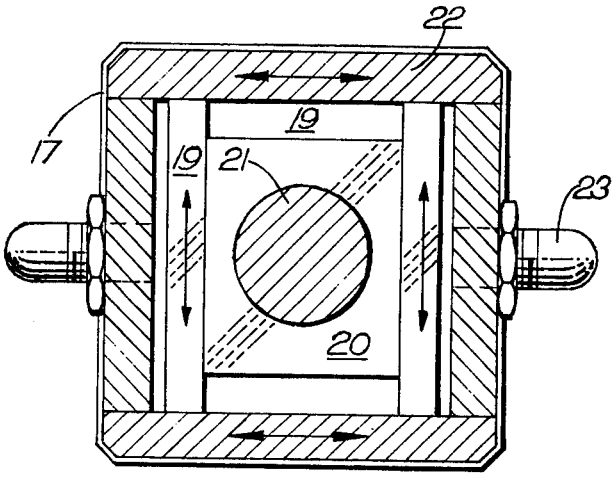
Figure 6:
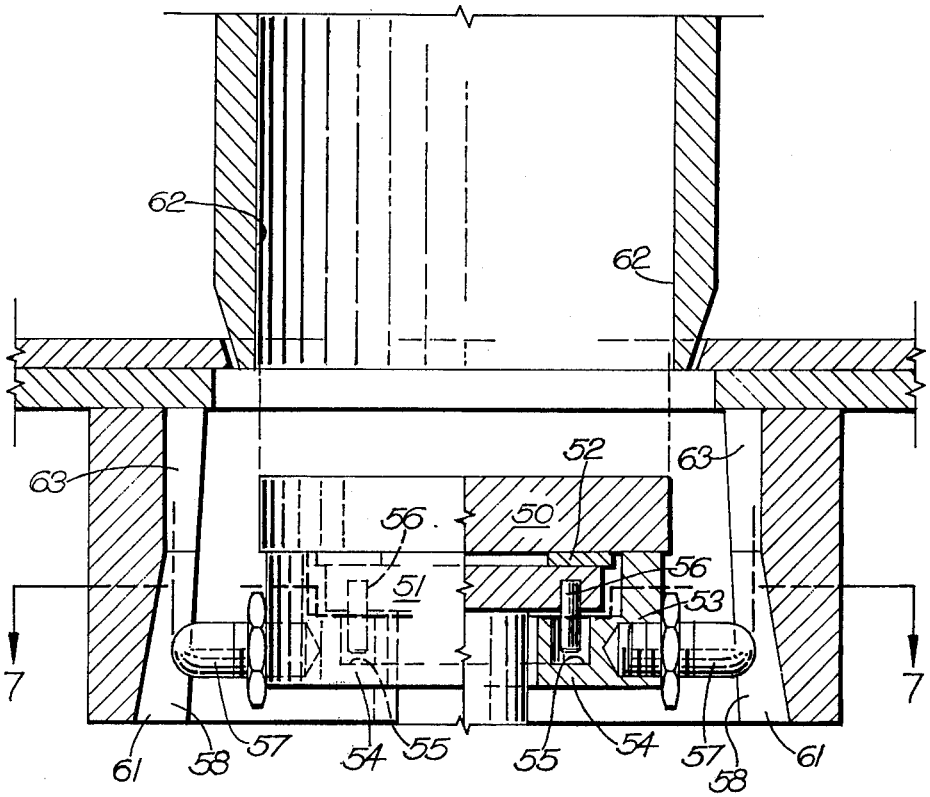
FIG. 6 is a cross-sectional view of another embodiment of the invention directed to a circular bottom block.
Figure 7:
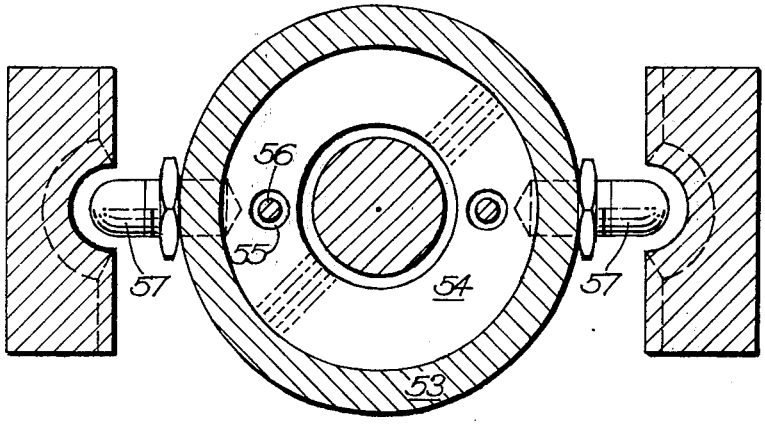
FIG. 7 is a cross section taken through 7—7 of FIG. 6.

Another embodiment directed to a circular bottom block is shown in FIGS. 5 and 6. The bottom block 50 of generally circular horizontal cross sections is slidably mounted on support member 51. Preferably, a bearing member 52 is disposed between bottom block 50 and support member 51 to facilitate horizontal movement of the bottom block. A generally L-shaped member 53 depends from and is suitably affixed to the lower surface of bottom block 50 to loosely lock the bottom block to support member 51 but to still allow for horizontal movement of the bottom block 50. The horizontally extending leg 54 of member 53 is provided with cavities 55 which receive the dowel-like member 56 extending downwardly from the support member 51. The cavities 55 and dowel-like members 56 are appropriately sized to ensure the insertion of extensions 57 into the recess defined by guide surfaces 58. As in prior embodiment, the guide surfaces 58 comprise two sections, a lower section 61 which converges toward the discharge end of the mold 62 (shown in phantom) and an upper section 63 which generally has the same horizontal cross section as the upper end of converging section 61. Screw and other type connectors are not shown in the drawings for purposes of clarity.

The operation of the assembly shown in FIGS. 5 and 6 functionally follows that of the assembly shown in FIGS. 1–4. As the bottom block is raised into position, the guide extensions 57 enter into the cavities defined by guide surfaces 58 and if the bottom block is out of alignment, the converging guide surfaces 61 cause the bottom block to move horizontally so as to ensure correct alignment of the bottom block with the mold bore. Entry of the guide extensions 57 into the recess defined by the guide surfaces 58 is assured due to the restriction of movement imposed by the dowel members 56 disposed within cavities 55.

Figure 8:
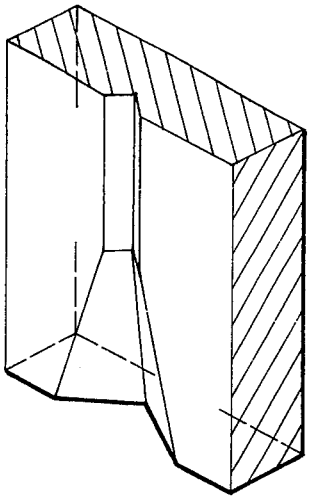
FIGS. 8–10 are perspective views of various types of guide surfaces.
Figure 9:
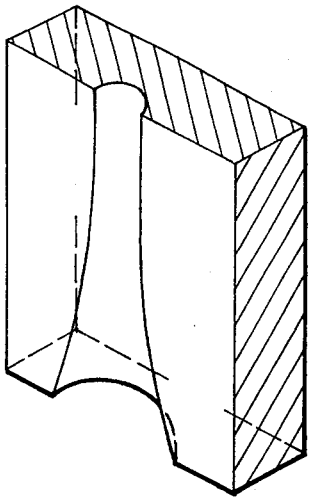
Figure 10:
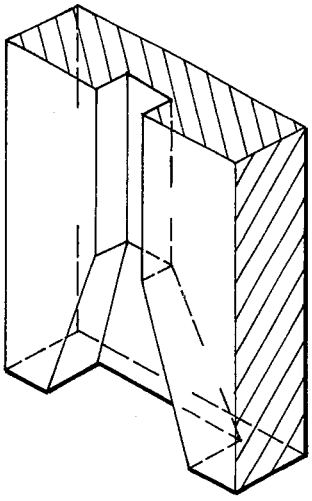

Although the guide surfaces shown in FIGS. 1–6 generally have a semicircular cross section in horizontal plane, other cross-sectional shapes and configurations can be used. For example, in FIG. 8, the horizontal cross section is angular. In FIG. 9, the change between the upper and lower section is a gradual one, and, in FIG. 10, the horizontal cross section is generally rectangular or channel-shaped. The guide extension tips need not be semispherical as shown in the drawing, but can be of any convenient size and shape, provided they can be appropriately inserted into the recess defined by the guide surfaces and thereby align the bottom block with the mold bore as the bottom block is raised into position.

Figure 11:
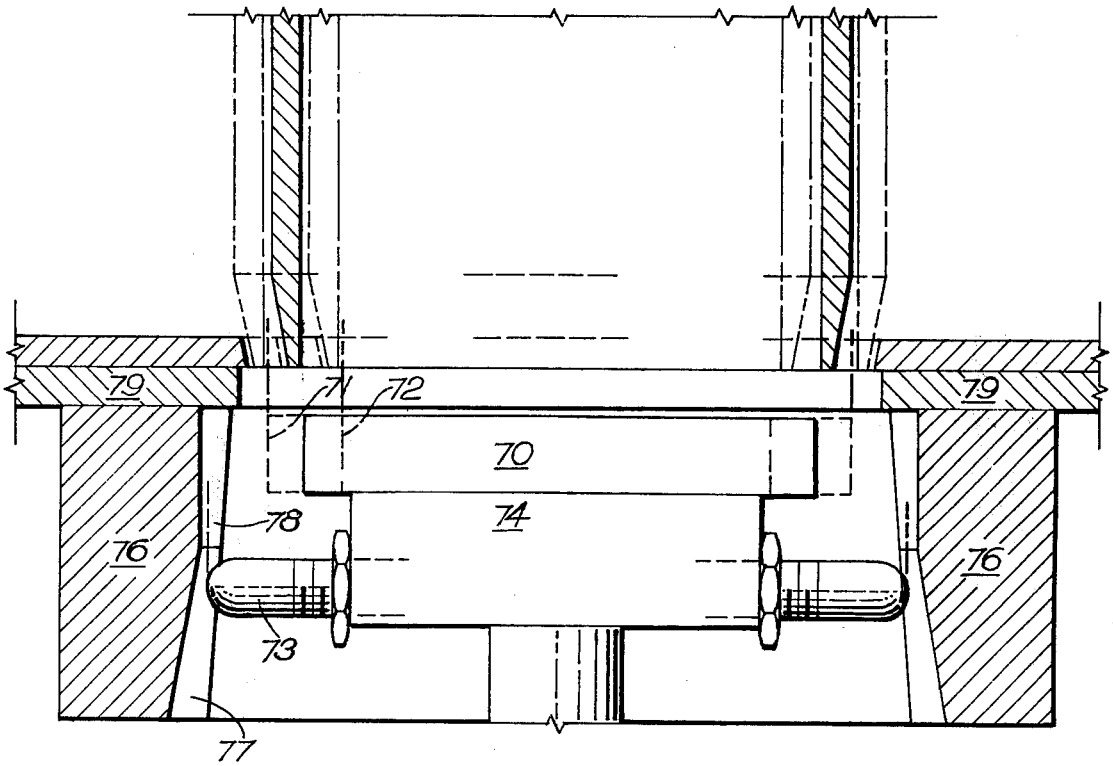
FIG. 11 is a cross section of the bottom block assembly of the present invention illustrating the adaptability of the assembly to different sized and shaped bottom blocks.

The present invention is adaptable to utilizing bottom blocks of different sizes as shown in FIG. 11. In this instance, the bottom block 70 would be replaced by another larger or smaller bottom block shown in phantom as 71 and 72, respectively. The guide extensions 73 are adjustable inwardly or outwardly to appropriately guide the bottom block into position as the bottom block is raised.

In accordance with the present invention, only two guide surfaces and two guide extensions are required, but more may be used if desired. By necessity, the members containing the recessed guide surfaces must not be positioned in the horizontal plane any closer than the downward projection of the mold bore periphery. If otherwise, the bottom block could not be readily inserted into the mold.

In the drawings, two means are provided to restrict the horizontal movement and the rotation of the bottom block. However, other means can be employed if desired. In addition, the restrictive means described in FIGS. 1–4 for square shaped bottom blocks can be readily employed with circular bottom blocks shown in FIGS. 5 and 6 and vice versa.

Generally, the recessed guide surfaces are designed to accommodate for the allowed movement and rotation of the bottom block. For most applications, the maximum horizontal movement need not exceed 1 inch. Usually, for billet casting, a half an inch or less is adequate for self-centering characteristics. Allowable rotation of the bottom block should not exceed 45°, preferably not more than 10°.

It is obvious that various modifications and improvements can be made to the present invention without departing from the spirit of the invention and the scope of the appended claims.

What is claimed is:

1. In a vertical D.C. casting apparatus for light metal comprising an open-ended D.C. mold and a bottom block adapted to be inserted into the mold prior to casting, the improvement comprising:

a. a bottom block adapted to be inserted into the mold and having sufficient dimensions to seal the discharge end of the mold;

b. a vertically moving bottom block support member, the upper surfaces of which are adapted for slidable contact with the bottom surfaces of the bottom block;

c. retaining means to loosely lock the bottom block to the support member and thereby allow for slidable horizontal movement of the bottom block with respect to the support member;

d. at least two recessed guide surfaces disposed below the mold and away from the downwardly projected periphery of the mold bore, at least the lower portion of the recessed guide surfaces converging toward the discharge end of the mold;

e. guide extensions in association with the bottom block which are adapted to be inserted into the recess defined by the guide surfaces as the bottom block is raised, to thereby align the bottom block with respect to the mold bore and prevent any contact between the bottom block and mold; and f. means to restrict the movement and the rotation of the bottom block in a horizontal plane to ensure insertion of the guide extensions into the recess defined by the guide surfaces.

2. The improvement of claim 1 wherein the horizontal cross section of the guide is semicircular.

3. The improvement of claim 1 wherein the restricting means comprises at least two vertically disposed dowel-like members which are adapted to be inserted into the two separate cavities.

4. The improvement of claim 1 wherein a bearing member is disposed between the bottom block and the bottom block support member.

5. The improvement of claim 1 wherein the retaining means is a member having a generally L-shaped cross section, the inwardly extending leg thereof adapted to encompass at least a portion of the periphery of the support member.

6. The improvement of claim 5 wherein the restricting means comprises at least two dowel-like members which depend from the bottom block support member and are adapted to be received by cavities provided in the inwardly extending leg of the retaining means.

7. The improvement of claim 5 wherein the retaining means and the lower surfaces of the bottom block define a trackway which is adapted to receive a rectangularly shaped bottom block support member and to thereby restrict the bottom block to rectilinear movement with respect to the support member and wherein the support member is provided with a recessed trackway in the lower surface thereof which is adapted to receive a second rectangularly shaped support member and to restrict the first support member to rectilinear movement with respect to the second member, said rectilinear movements being perpendicular.

8. The improvement of claim 3 wherein the vertically disposed dowel-like members depend from the bottom block support member.

* * * * *

UNITED STATES PATENT OFFICE

CERTIFICATE OF CORRECTION

PATENT NO. : 3,957,105

DATED : May 18, 1976

INVENTOR(S) : John J. Foye

It is certified that error appears in the above-identified patent and that said Letters Patent are hereby corrected as shown below:

Column 2, Line 4, "bottom would" should be --bottom block would--

Column 3, Line 3, "surfaces" should be --surface--

Column 6, Line 6, "guide is" should be --guide surfaces is--

Column 6, Line 35, "second member" should be --second support member--

Signed and Sealed this

Ninth Day of November 1976

[SEAL]

*Attest:*

RUTH C. MASON
*Attesting Officer*

C. MARSHALL DANN
*Commissioner of Patents and Trademarks*